US010939701B2

(12) United States Patent
Lisan et al.

(10) Patent No.: US 10,939,701 B2
(45) Date of Patent: Mar. 9, 2021

(54) TOBACCO SMOKE FILTER

(71) Applicant: ESSENTRA FILTER PRODUCTS DEVELOPMENT CO. PTE. LTD, Singapore (SG)

(72) Inventors: Ahmad Fashihul Lisan, Sidoarjo (ID); Roy Alingalan, Sidoarjo (ID); Sulistyo Widodo, Sidoarjo (ID); Antony Mccormack, Heddon on the Wall (GB)

(73) Assignee: ESSENTRA FILTER PRODUCTS DEVELOPMENT CO. PTE. LTD, Singapore (SG)

( * ) Notice: Subject to any disclaimer, the term of this patent is extended or adjusted under 35 U.S.C. 154(b) by 0 days.

(21) Appl. No.: 14/897,886

(22) PCT Filed: Jun. 12, 2014

(86) PCT No.: PCT/EP2014/062202
§ 371 (c)(1),
(2) Date: Dec. 11, 2015

(87) PCT Pub. No.: WO2014/198815
PCT Pub. Date: Dec. 18, 2014

(65) Prior Publication Data

US 2016/0106147 A1 Apr. 21, 2016

(30) Foreign Application Priority Data

Jun. 13, 2013 (GB) ..... 1310599.4

(51) Int. Cl.
*A24D 3/14* (2006.01)
*A24D 3/04* (2006.01)
*A24D 3/02* (2006.01)

(52) U.S. Cl.
CPC ..... *A24D 3/14* (2013.01); *A24D 3/0229* (2013.01); *A24D 3/0275* (2013.01); *A24D 3/0279* (2013.01); *A24D 3/04* (2013.01)

(58) Field of Classification Search
CPC ..... A24D 3/14; A24D 3/0229
(Continued)

(56) References Cited

U.S. PATENT DOCUMENTS 4,180,536 A * 12/1979 Howell, Jr. ..... A24D 3/0237 264/53
4,580,584 A * 4/1986 Reynolds ..... A24D 3/043 131/336

(Continued)

FOREIGN PATENT DOCUMENTS

CN 1137364 A 12/1996
CN 2415620 Y 1/2001

(Continued)

OTHER PUBLICATIONS

"Define." Merriam-Webster.com. Merriam-Webster, n.d. Web. Jul. 31, 2018.*

(Continued)

*Primary Examiner* — Eric Yaary
*Assistant Examiner* — Russell E Sparks
(74) *Attorney, Agent, or Firm* — Flynn Thiel, P.C.

(57) ABSTRACT

A tobacco smoke filter or filter element including a longitudinally extending core of tobacco smoke filtering material of circumference 14 to 17 mm which includes a channel which extends longitudinally from an end of the core; wherein the core further includes a plasticiser in an amount of 17 to 19% by weight of the tobacco smoke filtering material.

23 Claims, 2 Drawing Sheets

| | At constant tow weight of 3.3g/10 rods and 5Y30 tow | | |
|---|---|---|---|
| | Less than 17% | 17%-19% | More than 19% |
| Effects on hardness | <93% (unacceptable) | Within limits | >97% (unacceptable) |
| Effects on visual quality | Increased incidence of inner tube hairiness | | |
| Filter Condition |  |  | |

(58) Field of Classification Search
USPC ..... 131/341
See application file for complete search history.

(56) References Cited

U.S. PATENT DOCUMENTS

| | | | | | |
|---|---|---|---|---|---|
| 4,911,184 | A * | 3/1990 | Case | A24D 1/00 | 131/364 |
| 5,271,419 | A * | 12/1993 | Arzonico | A24B 15/14 | 131/336 |
| 5,823,201 | A * | 10/1998 | Matsumura | A24D 3/10 | 131/331 |
| 5,913,311 | A * | 6/1999 | Ito | A24D 3/04 | 131/332 |
| 5,947,126 | A * | 9/1999 | Wilson | A24D 3/10 | 131/331 |
| 6,206,007 | B1 * | 3/2001 | Yoshida | A24D 3/043 | 131/331 |
| 2005/0066984 | A1 | 3/2005 | Crooks et al. | | |
| 2005/0161055 | A1 | 7/2005 | Rozim | | |
| 2006/0021624 | A1 | 2/2006 | Gonterman et al. | | |
| 2008/0251091 | A1 * | 10/2008 | Schuetz | A24D 3/048 | 131/332 |
| 2011/0048436 | A1 * | 3/2011 | Fiebelkorn | A24D 3/04 | 131/338 |
| 2011/0120481 | A1 * | 5/2011 | Besso | A24D 3/0212 | 131/275 |
| 2011/0162667 | A1 * | 7/2011 | Burke | A24D 3/062 | 131/332 |
| 2011/0247637 | A1 * | 10/2011 | Duke | A24D 3/048 | 131/108 |
| 2012/0048286 | A1 * | 3/2012 | Luan | A24D 3/043 | 131/344 |
| 2012/0118309 | A1 * | 5/2012 | Taniguchi | A24D 3/10 | 131/342 |
| 2012/0255569 | A1 | 10/2012 | Beard et al. | | |
| 2012/0291792 | A1 | 11/2012 | Treadaway et al. | | |
| 2013/0023395 | A1 | 1/2013 | Nakamura | | |
| 2014/0034571 | A1 | 2/2014 | Torai et al. | | |
| 2015/0296878 | A1 * | 10/2015 | Mucalo | A24D 1/002 | 131/335 |

FOREIGN PATENT DOCUMENTS

| | | | | |
|---|---|---|---|---|
| CN | 102166041 | A | 8/2011 | |
| GB | 1 132 631 | | 11/1968 | |
| GB | 1 308 661 | | 2/1973 | |
| GB | 1 330 936 | | 9/1973 | |
| GB | 2 007 490 | A | 5/1979 | |
| GB | 2 091 078 | A | 7/1982 | |
| GB | 2489491 | A * | 10/2012 | C08J 5/18 |
| JP | 2005522208 | A | 7/2005 | |
| JP | 2013510566 | A | 3/2013 | |
| WO | WO 2007/135414 | A1 | 11/2007 | |
| WO | WO 2011/058319 | A1 | 5/2011 | |
| WO | WO 2011/114440 | A1 | 9/2011 | |
| WO | WO 2011/148130 | A1 | 12/2011 | |
| WO | WO 2012/025723 | A1 | 3/2012 | |
| WO | WO 2012/029117 | A1 | 3/2012 | |
| WO | 2012042199 | A1 | 4/2012 | |
| WO | 2012132972 | A1 | 10/2012 | |
| WO | 2013/029881 | A1 | 3/2013 | |
| WO | WO 2015/036454 | A1 | 3/2015 | |

OTHER PUBLICATIONS

Search Report from the UKIPO issued in Appln. No. GB1310599.4 dated Dec. 12, 2013 (3 pages).
International Search Report issued in Application No. PCT/EP2014/062202 dated Oct. 2, 2014 (4 pages).
Office Action issued in Japanese Appln. No. 2016-518487 dated Mar. 27, 2018 with Office Action Summary in English (9 pages).
First Chinese Office Action issued in Application No. 2018072401973940, dated Jul. 27, 2018 (13 pages).
Office Action issued in Japanese Appln. No. 2016-518487 dated Dec. 3, 2019 with Office Action Summary in English (8 pages).
Office Action issued in European Appln. No. 14 732 128.5 dated Jan. 10, 2020 (7 pages).
Office Action issued in Japanese Appln. No. 2019-010272 dated Jan. 14, 2020 with Office Action Summary in English (8 pages).

* cited by examiner

| | At constant tow weight of 3.3g/10 rods and 5Y30 tow | | |
|---|---|---|---|
| | Less than 17% | 17%-19% | More than 19% |
| Effects on hardness | <93% (unacceptable) | Within limits | >97% (unacceptable) |
| Effects on visual quality | Increased incidence of inner tube hairiness | | |
| Filter Condition |  |  | |

TOBACCO SMOKE FILTER

The present invention relates to tobacco smoke filters and filter elements, e.g. for smoking articles such as cigarettes.

The manufacture of cigarette filters with a tubular structure is well-known. The method of manufacture typically relies on the thermoforming of a plasticised tow of cellulose acetate around a shaped die to form a continuous tube, which is then cut into finite lengths. Such methods may be used to form filters and filter elements that have an internal channel or bore extending from, and exposed at, the mouth end. The internal channel or bore may be circular in cross section, or may have a cross section of another defined shape (e.g. triangular, star-shaped, heart-shaped, etc.). The cross section of the channel is immediately visible at the mouth end and presents a distinctive image to the smoker.

Tubular cigarette filters do not normally provide a significant filtration effect as smoke is simply channelled along the central bore of the filter. Thus, these tubular filters would typically be used as the downstream element of a multi-segment cigarette filter with the upstream segment(s) providing the primary filtration effect and the tube element primarily providing a visual effect at the mouth end. This visual effect may be useful as, for example, an anti-counterfeiting measure.

It is also known to provide cigarette filters in a variety of different circumferences, typically from around 25 mm to around 14 mm, being known as 'standard', 'slim', 'superslim' and 'microslim' products as the filter circumference decreases within this range (e.g. from around 24.5 mm, to around 23 mm, to around 16-17 mm, to around 14-15 mm respectively). As the circumference decreases, so it becomes necessary to reduce the thickness of the wall to maintain the proportionality of the product. In addition, the hardness of the filter (as quantified using Filtrona hardness units, which are well-known in the art) must be maintained within an acceptable range to give a suitable tactile sensation to the smoker and for ease of assembling cigarettes with such filters.

To date, 'superslim' and 'microslim' tube filters have not been available, because of the difficulties of producing such filters (e.g. the allowable tolerances of the annular wall are proportionately tighter than for larger circumference filters to maintain acceptable appearance, and less cellulose acetate tow is required to form the annular section).

The applicants have developed superslim tube filters—i.e. filters with a diameter of less than around 17 mm—and processes for their manufacture. Such tubular filters can then be assembled into dual, or other multi-segment, (superslim) filters by means well-known in the art.

According to the present invention there is provided a tobacco smoke filter or filter element comprising a longitudinally extending (e.g. substantially cylindrical) core of tobacco smoke filtering material of circumference 14 to 17 mm (e.g. 16 to 17 mm) which includes (e.g. defines, surrounds) a channel (e.g. a bore, e.g. a cylindrical channel or bore) which extends longitudinally from an end (e.g. the downstream end) of the core; wherein the core further comprises a plasticiser in an amount of 17 to 19% by weight of the tobacco smoke filtering material.

Preferably the tobacco smoke filtering material is cellulose acetate (e.g. cellulose acetate tow). If the tobacco smoke filtering material is cellulose acetate, the cellulose acetate may be of (wall) density in the range of 0.25 to 0.41 g/cc, for example 0.25-0.33 g/cc. The cellulose acetate may be cellulose acetate of total filament denier of 30-36,000, e.g. 34,000 (for a filter of circumference 16-17 mm).

The preferred plasticiser is triacetin, although other plasticisers, for example TEGDA, Triethyl Citrate and Polyethylene Glycol may be used.

In preferred embodiment(s), there is provided a tobacco smoke filter or filter element comprising a longitudinally extending (e.g. substantially cylindrical) core of cellulose acetate tow of circumference 14 to 17 mm (e.g. 16 to 17 mm) which includes (e.g. defines, surrounds) a channel (e.g. a bore, e.g. a cylindrical channel or bore) which extends longitudinally from an end of the core; wherein the core further comprises a triacetin plasticiser in an amount of 17 to 19% by weight of the cellulose acetate tow.

Preferably the channel or bore extends from one end, to the other, of the longitudinally extending core.

The applicants have found that plasticiser levels below 17% give rise to increased incidence of inner tube hairiness (i.e. poor channel/bore "tube" definition resulting from stray fibres being visible along the central bore); and values greater than 19% give rise to unacceptably high hardness and increased propensity of 'coring' (i.e. voids within the fibrous material where the fibre has been locally dissolved). This is shown in FIG. 2 and discussed below.

Preferably, the longitudinally extending (e.g. substantially cylindrical) core of tobacco smoke filtering material (e.g. cellulose acetate tow) has a hardness of 93% or more Filtrona hardness units, more preferably a hardness of 93-97% Filtrona hardness units. The Filtrona Hardness Unit scale of hardness is well known in the art. Following manufacturing trials, it was determined that the optimum hardness for tubular cigarette filters is in the range 93-97% (Filtrona hardness units). For a good visual appearance, the shape of the channel or bore must be well-defined (e.g. a round rather than an irregularly-shaped circle) and the channel or bore should be free from inner tube 'hairiness' (resulting from stray fibres being visible along the central bore). To ensure a good shape definition in a tube filter, the wall thickness must be maintained within tight tolerances and there must be no 'loose' or 'hairy' fibre defects visible.

Preferably, the longitudinally extending core of tobacco smoke filtering material is a substantially cylindrical core of tobacco smoke filtering material. Preferably the core of tobacco smoke filtering material is of circumference 16 to 17 mm (that is, it is the filter or filter element is a superslim filter or filter element).

In an example, the longitudinally extending (e.g. substantially cylindrical) core of tobacco smoke filtering material (e.g. of circumference 16 to 17 mm) includes (e.g. defines, surrounds) a cylindrical channel (e.g. a cylindrical bore) of circumference 8.8 mm to 9.42 mm (diameter 2.8 to 3.0 mm). This may be referred to as a "tube diameter" of 2.8 mm to 3.0 mm.

The applicants have surprisingly found an additional filtering effect associated with filters of the invention having a (e.g. cylindrical) channel or bore of circumference 8.8 mm to 9.42 mm (diameter 2.8 to 3.0 mm).

The applicants have found that filters/filter elements having the dimensions above give the best proportionality and visual appeal (which is also useful as a counterfeiting measure).

Thus, the applicants have determined, following extensive trials, the following values for optimum characteristics for the manufacture of superslim tubular cigarette filters:

Triacetin level: 17-19% by weight of cellulose acetate
Hardness: 93-97% (Filtrona hardness units)
Filter circumference: 16-17 mm (5.09-5.41 mm diameter)
Tube diameter: 2.8-3.0 mm (8.8-9.42 mm circumference)

In an example, the longitudinally extending (e.g. substantially cylindrical) core of tobacco smoke filtering material (e.g. of circumference 16 to 17 mm) includes (e.g. defines, surrounds) a cylindrical channel (e.g. a cylindrical bore) of circumference 11.94 mm to 12.88 mm (diameter 3.8 to 4.1 mm). This may be referred to as a "tube diameter" of 3.8 mm to 4.1 mm. These products may be referred to as "thin walled".

In an example, the longitudinally extending (e.g. substantially cylindrical) core of tobacco smoke filtering material (e.g. of circumference 14 to 15 mm) includes (e.g. defines, surrounds) a cylindrical channel (e.g. a cylindrical bore) of circumference 8.8 mm to 9.2 mm (diameter 2.8 to 3 mm). This may be referred to as a "tube diameter" of 2.8 mm to 3 mm.

According to the present invention in a further aspect there is provided a tobacco smoke filter or filter element comprising a longitudinally extending (e.g. substantially cylindrical) core of tobacco smoke filtering material of circumference 14 to 15 mm (e.g. 14.5 mm) which includes (e.g. defines, surrounds) a channel (e.g. a bore, e.g. a cylindrical channel or bore) which extends longitudinally from an end (e.g. the downstream end) of the core; wherein the core further comprises a plasticiser in an amount of 15 to 21% by weight, preferably 17 to 20% by weight, of the tobacco smoke filtering material.

Preferably the channel or bore extends from one end, to the other, of the longitudinally extending core.

Preferably, the longitudinally extending (e.g. substantially cylindrical) core of tobacco smoke filtering material (e.g. of circumference 14 to 15 mm) includes (e.g. defines, surrounds) a cylindrical channel (e.g. a cylindrical bore) of circumference 8.8 mm to 9.2 mm (diameter 2.8 to 3 mm).

Preferably the tobacco smoke filtering material is cellulose acetate (e.g. cellulose acetate tow). If the tobacco smoke filtering material is cellulose acetate, the cellulose acetate may be of (wall) density in the range of 0.25 to 0.41 g/cc, for example 0.25-0.33 g/cc. The cellulose acetate may be cellulose acetate of total filament denier of 30-36,000, e.g. 34,000 (for a filter of circumference 16-17 mm).

The preferred plasticiser is triacetin, although other plasticisers, for example TEGDA, Triethyl Citrate and Polyethylene Glycol may be used.

In a preferred embodiment(s), there is provided a tobacco smoke filter or filter element comprising a longitudinally extending (e.g. substantially cylindrical) core of cellulose acetate tow of circumference 14 to 15 mm (e.g. 14.5 mm) which includes (e.g. defines, surrounds) a channel (e.g. a bore, e.g. a cylindrical channel or bore) which extends longitudinally from an end of the core; wherein the core further comprises a triacetin plasticiser in an amount of 17 to 20% by weight of the cellulose acetate tow.

Preferably the channel or bore extends from one end, to the other, of the longitudinally extending core.

Preferably, the longitudinally extending (e.g. substantially cylindrical) core of cellulose acetate tow (e.g. of circumference 14 to 15 mm) includes (e.g. defines, surrounds) a cylindrical channel (e.g. a cylindrical bore) of circumference 8.8 mm to 9.2 mm (diameter 2.8 to 3 mm).

The applicants have found that a narrower filter may give satisfactory hardness and end appearance with a plasticiser level of up to about 20 or 21%.

According to the present invention in a still further aspect there is provided a tobacco smoke filter or filter element comprising a longitudinally extending (e.g. substantially cylindrical) core of tobacco smoke filtering material of circumference 14 to 17 mm (e.g. 14.5 mm) which includes (e.g. defines, surrounds) a channel (e.g. a bore, e.g. a cylindrical channel or bore) which extends longitudinally from an end (e.g. the downstream end) of the core; wherein the core further comprises a plasticiser in an amount of 15 to 20% by weight, preferably 15.5 to 20% by weight, preferably 17 to 20% by weight, of the tobacco smoke filtering material, and wherein the tobacco smoke filtering material is of (wall) density in the range of 0.25 to 0.41 g/cc, for example 0.35-0.41 g/cc.

Preferably the channel or bore extends from one end, to the other, of the longitudinally extending core.

In an example, the longitudinally extending (e.g. substantially cylindrical) core of tobacco smoke filtering material is of circumference 14 to 15 mm and includes (e.g. defines, surrounds) a cylindrical channel (e.g. a cylindrical bore) of circumference 8.8 mm to 9.2 mm (diameter 2.8 to 3 mm).

In another example, the longitudinally extending (e.g. substantially cylindrical) core of tobacco smoke filtering material is of circumference 16 to 17 mm and includes (e.g. defines, surrounds) a cylindrical channel (e.g. a cylindrical bore) of circumference 11.94 mm to 12.88 mm (diameter 3.8 to 4.1 mm). This may be referred to as a "tube diameter" of 3.8 mm to 4.1 mm. These products may be referred to as "superslim thin walled" products.

Preferably the tobacco smoke filtering material is cellulose acetate (e.g. cellulose acetate tow). The cellulose acetate may be cellulose acetate of total filament denier of 30-36,000, e.g. 34,000 (for a filter of circumference 16-17 mm).

The preferred plasticiser is triacetin, although other plasticisers, for example TEGDA, Triethyl Citrate and Polyethylene Glycol may be used.

The applicants have found that a plasticiser level of up to about 20 or 21% and a filtering material wall density of up to 0.41 g/cc may provide a filter, e.g. a superslim thin walled filter, of satisfactory hardness and end appearance.

Any filter or filter element of the invention may include a wrapper (e.g. of plugwrap paper) engaged around the longitudinally extending core.

The tobacco smoke filter or filter element may be of length 12 to 40 mm, e.g. 17 to 35 mm, e.g. 20 to 30 mm.

In the manufacture of standard size tubular filter products, it is known to apply a higher plasticiser level to the cellulose acetate tow than would be used in the manufacture of conventional 'monoacetate' filters. Such conventional filters would typically use around 6-8% w/w plasticiser in relation to cellulose acetate fibre weight. In addition, more cellulose acetate tow is used in the manufacture of tube filters than conventional (uniform cross-sectional) filters; the additional material is required to help give the necessary hardness to the final product. Typically, two bales of cellulose acetate tow would be used for the manufacture of tube filters whereas a single bale would be sufficient for the manufacture of conventional filters. A bale of tow contains filamentary fibres of defined filament denier and total denier, as well-known to those skilled in the art. The preferred plasticiser is triacetin, although alternative plasticisers, for example TEGDA, Triethyl Citrate and Polyethylene Glycol may also be used. Thus, for example, two bales of cellulose acetate tow (each with a total filament denier of 30-35,000) would be used in the manufacture of a standard size tube filter (e.g. with an outer diameter of 7.8 mm and a tube diameter of 5 mm).

In the manufacture of conventional superslim cigarette filters, it is known to use a cellulose acetate (CA) bale of low total denier—e.g. a total denier of 15-17,000—because less fibre is required per unit length for narrower filters. Low total denier tows are more expensive per unit weight, so a tube process based on two bales of low total denier tow would be comparatively very costly in terms of material.

The applicants have found that for the manufacture of superslim tube filters according to the invention, it is possible to use a single bale of cellulose acetate of a higher total denier (e.g. 34,000) rather than two bales of lower total denier (e.g. 2 bales of 17,000). This simplifies the process in that only one control of plasticiser level is necessary and the machine settings can be more easily adjusted to achieve optimum quality. Further, the applicants have found that, surprisingly, the quality of the product filters may be better in terms of end appearance (good round shape with minimum ovality, reduced hairiness visible in the channel) when only a single source (bale) of filtering material is used. Further, there is a cost saving because low total denier tows are more expensive per unit weight, as set out above.

According to the present invention in a further aspect there is provided a method of production of a tobacco smoke filter or filter element comprising a longitudinally extending (e.g. substantially cylindrical) core of tobacco smoke filtering material of circumference 14 to 17 mm (e.g. 16 to 17 mm) which includes (e.g. defines, surrounds) a channel (e.g. a bore, e.g. a cylindrical channel or bore, although it will be appreciated that this could be of any other symmetrical shape—e.g. triangular, star-shaped or heart-shaped) which extends longitudinally from an end (e.g. the downstream end) of the core; wherein the core further comprises a plasticiser in an amount of 15.5 to 21% by weight of the tobacco smoke filtering material, for example in an amount of 17 to 19% by weight of the tobacco smoke filtering material; the method comprising:

- continuously drawing the tobacco smoke filtering material (e.g cellulose acetate tow, e.g. cellulose actetate tow of total denier 30,000 to 36,000) from a single source;
- applying plasticiser (e.g. triacetin) to the filtering material; and
- thermoforming the tobacco smoke filtering material to which plasticiser has been applied around a shaped die to form a continuous tube.

The tobacco smoke filtering material for the longitudinally extending core may be for example any of those materials (usually filamentary, fibrous, web or extruded) conventionally employed for tobacco smoke filter manufacture. The filtering material may be natural or synthetic filamentary tow, e.g. of cotton or plastics such as polyethylene or polypropylene, or cellulose acetate filamentary tow. It may be, for example, natural or synthetic staple fibres, cotton wool, web material such as paper (usually creped) and (e.g. synthetic) non-wovens, and extruded material (e.g. starch, synthetic foams, extruded foams). As set out above, it is preferred that the filtering material is cellulose acetate.

According to the present invention in a further aspect there is provided a filter comprising a filter element of the present invention (as described herein) joined (abutted) at its upstream end to a further filter element. The further filter element may be of any kind known in the art, for example a wrapped acetate filter element, a non wrapped acetate (NWA) filter element, a monoacetate filter element etc, a filter element which includes an adsorbent (e.g. a particulate adsorbent, e.g. activated carbon), a filter element which includes one or more (e.g. frangible) capsules, e.g. as disclosed in UK Patent application No. GB1316210.2 of the present applicant, and applications claiming priority therefrom, etc. The filter may further comprise a wrapper (e.g. paper plugwrap) engaged around the filter elements. The abutted filter elements wrapped with plugwrap may form a dual (or other multiple) filter, as is well known in the art. The filter element of the invention will generally be located at the downstream end of such a dual, or other multiple, filter, so it is visible at the mouth end.

Herein the term "downstream" means towards the end of the filter/filter element/filter cigarette which is closest to the mouth of the smoker of a filter cigarette (e.g. when the filter/filter element is attached to a tobacco envelope in a filter cigarette). The term "upstream" means towards the end of the filter/filter element which is closest to the tobacco envelope of the filter cigarette (e.g. when the filter/filter element is attached to a tobacco envelope in a filter cigarette).

In a filter cigarette according to the invention, a filter of the invention (or a filter which includes a filter element of the invention) is joined to a wrapped tobacco rod with one end of the filter towards the tobacco. The filter may be joined to the wrapped tobacco rod by ring tipping [which engages around just the adjacent ends of the (wrapped) filter and rod to leave much of the filter wrap exposed]. The filter may be joined by a full tipping overwrap (which engages around the full filter length and the adjacent end of the tobacco rod).

The filter, filter element or filter cigarette according to the invention may be ventilated by methods well known in the art, e.g. by use of a pre-perforated or air-permeable outer wrapper, and/or laser perforation of the outer wrapper and, if present, tipping overwrap. A ventilating full tipping overwrap may likewise be inherently air-permeable or provided with ventilation holes, and in ventilated products where both outer wrapper and tipping overwrap are present ventilation through the overwrap will usually (and preferably) be in register with that through the plugwrap. Ventilation holes through the filter outer wrapper, or through a tipping overwrap, or through both simultaneously, may be made by laser perforation during filter or filter cigarette production, as is well known in the art.

According to the invention in a further aspect there is provided a multiple rod comprising a plurality (e.g. 2, 4, 6 etc.) of filters (or filter elements) as described above and/or herein integrally joined end-to-end in a mirror image relationship.

The present invention will now be illustrated with reference to the attached drawings in which.

Figure 1:
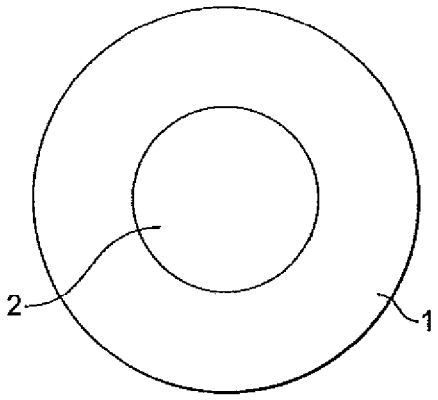
FIG. 1 is an end view of a tobacco smoke filter element according to an example of the invention.

FIG. 1 shows one end (the downstream or mouth end) of a filter element according to one embodiment of the invention. The filter element comprises a thermoformed longitudinally extending core 1 of plasticised cellulose acetate filtering material of circumference 16.5 mm. The longitudinally extending (annular) core defines a channel or bore 2 of circular cross section which extends longitudinally through the longitudinally extending core. The channel or bore 2 has inner diameter of approximately 2.8 mm (circumference 8.8 mm) and extends from one end, to the other, of the core. Thus, the core 1 has substantially annular cross section.

The longitudinally extending core 1 is made by thermoforming a plasticised cellulose acetate filamentary tow of total filament denier 30,000 to 36,000 (e.g. 34,000) which includes a triacetin plasticiser in an amount of 17% to 19% (e.g. 18%) by weight of the cellulose acetate.

It will be appreciated that the filter element of FIG. 1 may be joined (abutted) at its upstream end to another filter element (not shown), and the abutted filter elements wrapped with plugwrap, to form a dual filter, as is well known in the art. A dual filter incorporating the filter element of FIG. 1 may be joined at its upstream end to a wrapped tobacco rod (not shown) by means of, for example, a full tipping overwrap which surrounds and engages the full length of the dual filter and the adjacent end only of the wrapped tobacco rod, to form a filter cigarette. Cigarettes which include dual filters are well known.

The filter element of FIG. 1 is made by thermoforming a longitudinally advancing flow of plasticised tow of cellulose acetate around a shaped die (of circular cross section) to form a continuous longitudinally advancing tube, by methods which are well known in the art, for example as in GB 2091078 and references therein. The continuously advancing thermoformed tube is then cut into finite length products (e.g. dual (or other multiple length) product rods comprising two (or other multiple) filter elements of FIG. 1 joined end to end). The dual product rods may be further processed into dual filters (e.g. using a filter maker) and filter cigarettes, by methods well known in the art.

As seen in FIG. 1, the cross section of the channel 2 is immediately visible at the mouth end of filter and is therefore visible at the mouth end of the ultimate product (dual filter or filter cigarette), and hence presents a distinctive image to the smoker (which may also be useful as an anti counterfeiting measure). Provision of filters having a controlled and acceptable visual appearance provided by the channel is therefore highly important.

The applicants have determined, following extensive trials, the following values for optimum characteristics for the manufacture of superslim tubular cigarette filters:

Triacetin level: 17-19% by weight of cellulose acetate

Hardness: 93-97% (Filtrona hardness units)

Filter circumference: 16-17 mm (5.09-5.41 mm diameter)

Tube diameter: 2.8-3.0 mm (8.8-9.42 mm circumference)

Some of these trials are described in the following Examples 1 and 2.

EXAMPLE 1

6 variants (labelled A-F) of superslim tube filter rods were produced. These filter rods may be thought of a number of filter elements similar to that shown in FIG. 1 joined end to end (to form a multiple filter rod). Each filter rod had an outer circumference of 16.5 mm, an inner tube (channel or bore) diameter of approx. 2.8 mm, and a wall thickness of the longitudinally extending core (annular core) of approx. 1.2 mm. These filter rods were cut to a length of 84 mm. Details are given below (CA=cellulose acetate).

| Trial | CA Tow Type* | Weight of CA (g/rod) | Triacetin Level (%) | CA Wall Density (g/cc) |
|---|---|---|---|---|
| A | 7.3Y36000 | 0.352 | 18.30 | 0.287 |
| B | 7.3Y36000 | 0.373 | 17.79 | 0.303 |
| C | 8.0Y32000 | 0.342 | 18.96 | 0.279 |
| D | 8.0Y32000 | 0.370 | 17.15 | 0.301 |
| E | 5.0Y30000 | 0.333 | 17.88 | 0.272 |
| F | 5.0Y30000 | 0.352 | 18.14 | 0.288 |

*The CA Tow type is expressed as filament denier/fibre cross-section/total denier, as is well known in the art.

Figure 3:
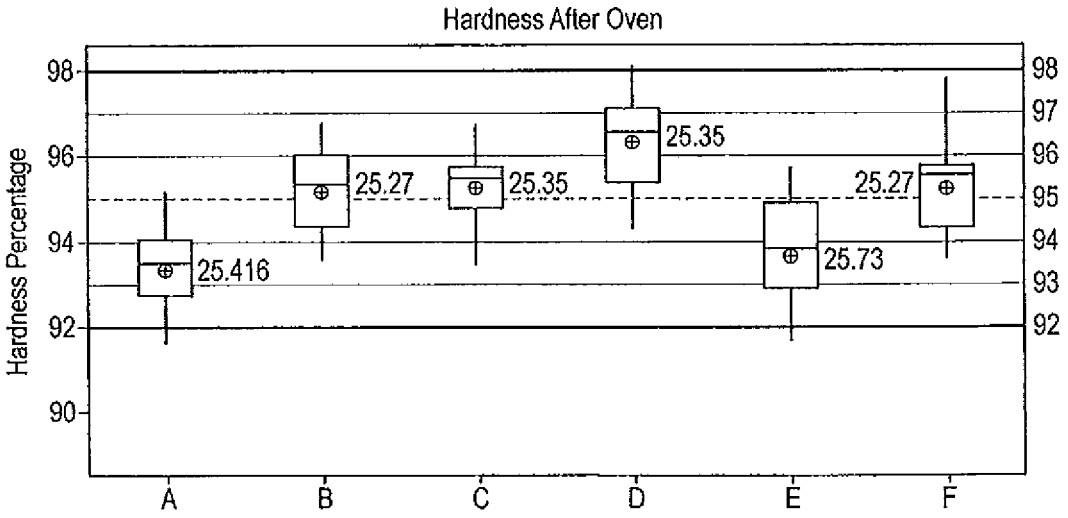
FIG. 3 shows the results of hardness testing of filter elements according to an example of the invention.
Figure 2:
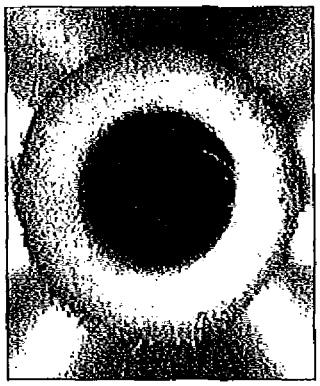
FIG. 2 shows the effect of hardness, visual quality and filter condition of the amount of plasticiser (triacetin)
Figure 2:
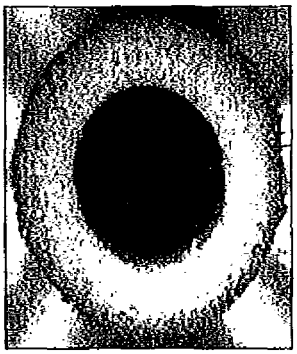

The rods were tested for hardness using a standard method for determining hardness in terms of Filtrona hardness units, the Filtrona Hardness Unit scale of hardness being well known in the art. The hardness results are shown in FIG. 3. All rods had satisfactory hardness of 93-97% Filtrona hardness units.

Further, all rods having this hardness had acceptable visual ('hairiness') characteristics, especially rods C, D and E.

The applicants have concluded on the basis of these, and other results, that a cellulose acetate wall density in the range of 0.25-0.33 g/cc is preferred for acceptable hardness and visual characteristics. The applicants found that when a tow weight is used that falls below that required for this minimum density and/or triacetin levels of less than 17% w/w are used, hardness falls below the minimum 93%, and it is also becomes difficult to achieve the desired shape definition.

EXAMPLE 2

Dual filter tips of 16.75 mm circumference and 27 mm length were prepared ('A'), with a downstream 7 mm long circular bore mouth end filter element (section) which is a filter element of the invention. The downstream filter element comprised a longitudinally extending substantially cylindrical core of length 7 mm of cellulose acetate tow of circumference 16.75 mm. The core defined a cylindrical channel or bore of bore 3.0 mm diameter which extends longitudinally from one end to the other of the core. The dual filter tip (filter of the invention) also includes an upstream filter element of 20 mm length comprising plasticised cellulose acetate. The two filter elements are joined with a paper plugwrap as is well known in the art.

Filter cigarettes incorporating these filters were then compared with similar filter cigarettes (not of the invention) of 23.1 and 24.2 mm circumference ('B' and 'C' respectively). A filter nicotine retention test was carried out on each sample. Retention is defined as the proportion of nicotine retained by the filter expressed as a percentage of the nicotine yield of the equivalent unfiltered cigarette, when the cigarette is smoked under ISO smoking conditions. In the retention test to measure the nicotine retention of the tube filter element, the tubes were separated after smoking and individually measured for nicotine content. The results are summarised in the following table:

| | A | B | C |
|---|---|---|---|
| Filter Circumference (mm) | 16.75 | 23.10 | 24.20 |
| Tube Bore (mm) | 3.0 | 4.6 | 5.0 |
| 7 mm Tube Pressure Drop (mm water) | 1 | 0 | 0 |
| 7 mm Tube Nicotine Retention (%) | 2.2 | 3.1 | 2.2 |
| Tube Surface Area (mm2) | 66.0 | 101.2 | 110.0 |
| Tube Volume (mm3) | 49.5 | 116.3 | 137.5 |
| Surface Area/Volume | 1.33 | 0.87 | 0.80 |

The filter elements of the invention surprisingly make a small contribution to the retention of the filter. Without wishing to be bound by theory it is believed that the filtering effect is due to smoke being deposited on the inner wall of the narrow tube or bore (i.e. a surface effect). The data shows that the nicotine retention is surprisingly consistent, despite differences in surface area/volume ratio of these filters. This effect supports the use of tubes with a diameter of 3 mm (or less), particularly when used in a superslim filter.

EXAMPLE 3

The following parameters were examined:

Using different mandrel sizes to create different internal diameters for super slim shape filters (3 mm mandrel and 4 mm mandrel);

Using different tow types to determine the best material to use;

Comparing both single bale and double bale tow processes; and

Using different bobbins to create different outer sized circumference (i.e. down to 14.5 mm circumference, termed 'nano' filters).

Method

Filter rod samples were made using the methodologies described for Examples 1 and 2 above. These were manufactured at three different sizes:

Super Slim ("SS") Tube Filter Rods of 16.5 mm circumference×80 mm length and nominal 3 mm bore diameter;

Super Slim Tube Thin Walled ("SSTW") Tube Filter Rods of 16.5 mm circumference×80 mm length having nominal 4 mm diameter bore; and 'Nano' Slim Tube ("N") Filter Rods of 14.5 mm circumference×80 mm length having nominal 3 mm bore diameter.

These products gave wall thicknesses of around 1.2 mm, 0.8 mm and 0.9 mm respectively.

A total of six different types of cellulose acetate tow of differing numbers of bales, filament denier and total denier were used, as follows:

Single bale: 7.3Y/36,000; 8.0Y32,000; 5.0Y/30,000

Dual bales: 2×8.0Y/15,000; 2×6Y/17,000; 2×4.7Y/22,000

The filter rods produced were tested for the following parameters:

Hardness

Bore Size

Circumference (as measured seven days after manufacture)

Visual quality (especially ovality and 'hairiness' in the bore of the tube)

Fibre density—as calculated from the weight and dimensional data

The results obtained are given in the table below:

| Sample | Type[1] | Tow[2] | No. of Bales | Triacetin level (%) | Hardness (%) | Bore diam. (mm) | Filter circum. (mm) | Fibre density (g/cc) | Visual Quality |
|---|---|---|---|---|---|---|---|---|---|
| 1 | SS | 7.3Y/36 | 1 | 16.7 | 94.6 | 2.9 | 16.6 | 0.30 | |
| 2 | SS | 5Y/30 | 1 | 18.1 | 92.5 | 2.9 | 16.7 | 0.26 | |
| 3 | SS | 6Y/17 | 2 | 17.0 | 93.3 | 3.0 | 16.6 | 0.29 | |
| 4 | SSTW | 8Y/32 | 1 | 17.4 | 91.4 | 3.8 | 16.8 | 0.37 | Excellent |
| 5 | SSTW | 5Y/30 | 1 | 19.5 | 93.7 | 3.7 | 16.6 | 0.36 | |
| 6 | SSTW | 8Y/15 | 2 | 16.9 | 92.3 | 3.7 | 16.6 | 0.38 | |
| 7 | SSTW | 6Y/17 | 2 | 17.9 | 93.7 | 3.7 | 16.5 | 0.40 | |
| 8 | SSTW | 4.7Y/22 | 2 | 15.3 | 95.3 | 3.5 | 16.6 | 0.32 | Hairy (poor) |
| 9 | N | 7.3Y/36 | 1 | 16.9 | 96.9 | 2.8 | 14.6 | 0.40 | |
| 10 | N | 8Y/32 | 1 | 15.1 | 97.0 | 2.9 | 14.6 | 0.40 | |
| 11 | N | 5Y/30 | 1 | 20.0 | 96.8 | 2.9 | 14.5 | 0.37 | Excellent |
| 12 | N | 8Y/15 | 2 | 17.9 | 96.8 | 2.9 | 14.7 | 0.40 | |
| 13 | N | 6Y/17 | 2 | 14.5 | 97.1 | 2.9 | 14.6 | 0.42 | Hairy (poor) |
| 14 | N | 4.7Y/22 | 2 | 15.8 | 98.1 | 2.8 | 14.5 | 0.48 | |

Notes

[1]SS = Superslim; SSTW == Superslim Thin Walled; N = "Nano" tube

[2]Tow denier given as: filament/total × 1000

The visual qualities of the filters were tested using a Dinolite digital microscope measuring system at 30× magnification to assess the incidence of hairy fibres in the tube bore, shape deformity and ovality, from which it was concluded that the present invention may be used to provide superslim filters having thin walls, and nano filters of diameter 14 to 15 mm, of satisfactory hardness and end appearance.

At comparable hardness, and tow weight, a single bale process provided a product with a better visual quality than a filter produced from a double bale process. Further, a higher occurrence of 'hairy' filters was observed with double bale filters. In addition, a double bale tow process provided a higher tow weight on average (which is undesirable because the resultant filters would be more costly). This applied to SSTW and N filters, in addition to SS filters.

The invention claimed is:

1. A tobacco smoke filter or filter element comprising a longitudinally extending core of tobacco smoke filtering material of circumference 14 to 17 mm which defines a channel which extends longitudinally from an end of the core; wherein the core further comprises a plasticiser in an amount of 17 to 19% by weight of the tobacco smoke filtering material; wherein the plasticiser is applied to a surface of the tobacco smoke filtering material; wherein the core has a hardness of 93% or more Filtrona hardness units; and wherein the channel has a circumference of 8.8 mm to 9.42 mm.

2. A tobacco smoke filter or filter element according to claim 1 comprising a longitudinally extending core of tobacco smoke filtering material of circumference 16 to 17 mm.

3. A tobacco smoke filter or filter element according to claim 1 wherein the tobacco smoke filtering material is cellulose acetate.

4. A tobacco smoke filter or filter element according to claim 3, wherein the cellulose acetate is of density in the range of 0.25 to 0.41 g/cc.

5. A tobacco smoke filter or filter element according to claim 3, wherein the cellulose acetate is of total filament denier of 30-36,000.

6. A tobacco smoke filter or filter element according to claim 1 wherein the plasticiser is triacetin.

7. A tobacco smoke filter or filter element according to claim 1 wherein the longitudinally extending core of tobacco smoke filtering material is substantially cylindrical.

8. A tobacco smoke filter or filter element according to claim 1 wherein the channel is cylindrical.

9. A tobacco smoke filter or filter element according to claim 1 wherein the channel extends from one end, to the other, of the longitudinally extending core.

10. A tobacco smoke filter or filter element according to claim 1 further comprising a wrapper engaged around the longitudinally extending core.

11. A tobacco smoke filter or filter element according to claim 1 of length 12 to 40 mm.

12. A tobacco smoke filter comprising a filter element according to claim 1 joined at its upstream end to a further filter element.

13. A filter cigarette comprising a filter or filter element according to claim 1 joined to a wrapped tobacco rod with one end of the filter towards the tobacco.

14. A multiple rod comprising a plurality of filters or filter elements according to claim 1 integrally joined end-to-end in a mirror image relationship.

15. A tobacco smoke filter or filter element comprising a longitudinally extending core of tobacco smoke filtering material of circumference 14 to 15 mm which defines a channel which extends longitudinally from an end of the core; wherein the core further comprises a plasticiser in an amount of 15 to 21% by weight of the tobacco smoke filtering material; wherein the plasticiser is applied to a surface of the tobacco smoke filtering material; wherein the core has a hardness of 93% or more Filtrona hardness units; and wherein the channel has a circumference of 8.8 mm to 9.42 mm.

16. A tobacco smoke filter or filter element according to claim 15 wherein the channel extends from one end, to the other, of the longitudinally extending core.

17. A tobacco smoke filter or filter element according to claim 15 wherein the channel is cylindrical.

18. A tobacco smoke filter or filter element according to claim 15 wherein the tobacco smoke filtering material is cellulose acetate.

19. A tobacco smoke filter or filter element according to claim 18, wherein the cellulose acetate is of density in the range of 0.25 to 0.41 g/cc.

20. A tobacco smoke filter or filter element according to claim 18 wherein the cellulose acetate is of total filament denier of 30-36,000.

21. A tobacco smoke filter or filter element according to claim 15 wherein the plasticiser is triacetin.

22. A tobacco smoke filter or filter element comprising a longitudinally extending core of tobacco smoke filtering material of circumference 14 to 17 mm which defines a channel which extends longitudinally from an end of the core; wherein the core further comprises a plasticiser in an amount of 15 to 20% by weight of the tobacco smoke filtering material; wherein the plasticiser is applied to a surface of the tobacco smoke filtering material; wherein the tobacco smoke filtering material is of wall density in the range of 0.25 to 0.41 g/cc; wherein the core has a hardness of 93% or more Filtrona hardness units; and wherein the channel has a circumference of 8.8 mm to 9.42 mm.

23. A method of production of a tobacco smoke filter or filter element comprising a longitudinally extending core of tobacco smoke filtering material of circumference 14 to 17 mm which defines a channel with extends longitudinally from an end of the core; wherein the core furthercomprises a plasticizer in an amount of 15.5 to 21% by weight of the tobacco smoke filtering material; wherein the core has a hardness of 93% or more Filtrona hardness units; and wherein the channel has a circumference of 8.8 mm to 9.42 mm; the method comprising: continuously d rawingthe tobacco smoke filtering material from a single source; applying plasticizerto a surface of the filtering material; and thermoforming tobacco smoke filtering material to which plasticizer has been applied.

* * * * *